US005379603A

United States Patent [19]

Welch et al.

[11] Patent Number: 5,379,603

[45] Date of Patent: Jan. 10, 1995

[54] METHOD AND APPARATUS FOR PRECHILLING TAP WATER IN ICE MACHINES

[76] Inventors: Daniel L. Welch, 4817 E. 13th St., Tucson, Ariz. 85711; Jeff L. Love, 903 Leander Dr., Leander, Tex. 78641

[21] Appl. No.: 218,348

[22] Filed: Mar. 28, 1994

Related U.S. Application Data

[63] Continuation-in-part of Ser. No. 39,844, Mar. 30, 1993, abandoned.

[51] Int. Cl.[6] ..... F25C 1/12

[52] U.S. Cl. ..... 62/66; 62/348; 165/163

[58] Field of Search ..... 62/348, 66; 165/135, 165/156, 163

[56] References Cited

U.S. PATENT DOCUMENTS

| | | | |
|---|---|---|---|
| 2,403,272 | 7/1946 | Freer | 165/163 X |
| 2,648,956 | 8/1953 | Fletcher | 62/107 |
| 2,921,447 | 1/1960 | Gottschalk | 62/348 X |
| 3,871,444 | 3/1975 | Houser | 165/101 |
| 4,338,794 | 7/1982 | Haasis, Jr. | 62/348 |
| 4,347,894 | 9/1982 | Gerlach | 165/163 X |
| 4,798,061 | 1/1989 | LaConte | 62/348 |
| 4,848,102 | 7/1989 | Stanfill | 62/348 |
| 4,881,378 | 11/1989 | Bryant | 62/348 |

FOREIGN PATENT DOCUMENTS

| | | |
|---|---|---|
| 2243408 | 4/1975 | France . |
| 2476296 | 8/1981 | France . |
| 3012881 | 8/1981 | Germany . |
| 58-086386 | 5/1983 | Japan . |
| 1362538 | 8/1974 | United Kingdom . |

OTHER PUBLICATIONS

"Turbo-Cool" by Adi/Turbo-Cool 1901 Royal Lane #100 Dallas Texas 75229.

*Primary Examiner*—William E. Tapolcai
*Attorney, Agent, or Firm*—Michael P. Breston

[57] ABSTRACT

Prechilling the tap water with the cold waste water from an ice machine is achieved by using an insulated, elongated casing, which encloses a reservoir housing a heat exchanger made of a relatively long tubing of copper to provide a relatively long path of travel for the tap water. The heat exchanger is in the form of a coil followed by a substantially straight tube within and surrounded by the coil's turns. A hollow member, closed at one end, is spaced from the straight tube. The coil's turns surround the hollow member and the straight tube. Preferably, the hollow member is mounted over and is spaced from the straight tube to form there between an elongated chamber. In use, the tap water flows downwardly in the coil and upwardly through the straight tube. The cold waste water flows through the elongated chamber into the reservoir, thereby progressively and continuously increasing the temperature of the waste water and correspondingly decreasing the tap water's temperature.

17 Claims, 1 Drawing Sheet

METHOD AND APPARATUS FOR PRECHILLING TAP WATER IN ICE MACHINES

REFERENCE TO RELATED APPLICATION

This application is a continuation-in-part of application Ser. No. 08/039,844, filed Mar. 30, 1993, now abandoned.

BACKGROUND OF THE INVENTION

1. Field of the Invention

This invention relates generally to a method and apparatus for prechilling the warm tap water, fed into an ice maker machine to make ice cubes and the like, with the near freezing waste water ejected by the machine.

2. Description of the Prior Art

Ice making machines are now widely used, especially in warm climates, in hotels, schools, eating and drinking establishments, etc. Such machines use considerable electric or gas energy some of which is unnecessarily and needlessly wasted.

Ice makers are certified and rated in accordance with ARI Standard 810-91. Test conditions for standard ratings are 90° F. ambient air, 70° F. tap water, and about 30 psig water inlet pressure.

It is well known that productivity of an ice machine is a function, among other things, of its ambient air temperature and of the temperature of tap water used to make ice. The lower the tap water's temperature is, the higher will be the machine's ice yield during each ice "harvest". At the end of one or more harvest cycles, a considerable volume of unused 33°–34° F. cold waste water, in the vast majority of existing ice makers, is now being dumped down the drain, even though it has long been suggested to utilize the cold energy contained within the cold waste water ejected from the ice machine for prechilling its tap water requirements, as will now be described in more detail.

Even if the air temperature remains the same, lowering tap water's temperature by about 20° F. can considerably increase the machine's ice yield. A temperature drop of 30° F. in the summer has been a long-held desirata to owners of ice machines.

In addition to boosting the ice yield, other tangible benefits will be obtained including: savings on the amount of required floor space for the ice maker, on its cost and installation, and on its operating and maintenance expenses.

Usually the valuable space near an ice maker is very limited and crowded. Therefore, to obtain a higher ice production by replacing a smaller machine with a larger one may not be a desirable option.

But by using an effective, efficient and compact tap water prechiller, both the initial cost of a larger machine and its higher operating cost may be avoided; less heat will be injected into the room housing the ice machine thereby reducing the room's air conditioning load; less "wear and tear" will be experienced by the ice maker's active parts thereby prolonging their operational life; there will be less time for a mineral buildup on the machine's freeze plate and throughout its wetted areas; and the machine's bin will fill up faster with ice during peak demands because lowering the tap water's temperature will enable the ice maker to produce more ice in the same amount of time with little additional energy cost, or the same amount of ice in a shorter period of time.

Naturally, the above described cost savings and advantages prompted the expenditures of considerable efforts to arrive at practical water chilling methods and devices. Some of such prechillers had an insulated casing which enclosed a reservoir housing a heat exchanger fabricated from straight copper tubing or coiled. The casing has inlets for receiving the relatively warm tap water and the ejected cold waste water, an outlet to allow for discharging the prechilled tap water, and an overflow outlet to allow the excess waste water accumulated in the reservoir to escape.

The primary function of such a heat exchanger is to provide one path for the flow of the warm tap water, and another path for the flow of the cold waste water.

One type of heat exchanger had a copper pipe inside a plastic pipe. The potable water flowed in the copper pipe, and the cold waste water flowed through the annular space between the two pipes. This arrangement apparently was not successful perhaps due to the possible occlusion that may have occurred within the annular space due to mineral sediment accumulation.

U.S. Pat. No. 2,921,447 of Gottschalk describes a control device for discontinuing the operation of a water pump when other control devices might fail. In Col. 2, lns. 49–54 he suggests using a tap water prechiller as suggested in Howe's U.S. Pat. No. 2,775,100 which issued on Dec. 25, 1956.

Howe describes a common problem then faced by ice makers: "a substantial concentration of minerals of the type contained in the water used for the ice formation" (Col. 1, lns. 22–25) leads to an appreciable loss in the refrigeration capacity of the machine. Howe proposes discharging more of the cold water not used up during the ice formation (Col. 1, Ins. 32–35).

Howe very briefly also suggested to prechill the tap water. "As the water is discharged from the tank, it proceeds to a receiver 40 where it is passed in heat exchange relation with the water being supplied" by pipe 11 (Col. 4, lns. 26–29).

U.S. Pat. No. 4,338,794 of Hassis suggests prechilling the tap water as well as the refrigerant fluid in an ice cube making machine by using two copper coils within two chambers of an insulated casing. The potable water flows through one coil in one chamber, while in an adjacent chamber the other coil receives freon refrigerant. Cold waste water from the machine is allowed to flow through both chambers, resulting in a lowering of the temperatures of the tap water and of the freon.

In Frier's U.S. Pat. No. 2,403,272 is described a water cooler having an energy consuming refrigeration system, including a compressor and evaporator, which employs a vapor compression cycle during which the phase change of the freon is intended to achieve tap water cooling. The evaporator consists of a tank 1 housing a first coil 9 which surrounds a second coil 8 both made from very small diameter copper tubing. A hollow pipe 11, apparently made of metal, is mounted over inner coil 8. Pipe 11 has a bottom end open to the interior of tank 1 and a top end open to the cold water outlet 4. The tap water fills tank 1 and hollow member 11. As the freon flows under pressure spirally through coils 8, 9, it changes from liquid to vapor phase, while remaining at the same temperature throughout such change. The cold freon prechills both the water inside tank 1 and in pipe 11 as a result of its vaporization. The vaporized refrigerant leaves tank 1 and is returned back to the evaporator by the mechanical refrigeration system in liquid form to coils 8, 9 to start another cooling cycle as needed. Should a leak occur, the freon will contaminate the drinking water creating health and environmental hazards.

A water prechilling device is currently being sold under the trademark "Turbo-cool" by Adi/Turbo-Cool, 1901 Royal Lane Suite 100, Dallas, Tex. 75229. It apparently uses a heat exchanger, in the form of a straight copper pipe, within an insulated enclosed 4" cylindrical casing which collects the cold waste water from the ice maker. The casing has inlets for receiving the relatively warm tap water and the cold waste water, an outlet for discharging the prechilled tap water, and an overflow outlet to allow the excess waste water to escape. Apparently, the straight copper pipe receives the relatively warm tap water and discharges the prechilled tap water to the machine. In the heat exchange process, the waste water warms up due to the transfer of heat frown the warm tap water circulating through the straight copper pipe. The waste water's temperature rises while the temperature of the tap water flowing in the straight copper pipe decreases. This process is repeated after one or more ice harvest cycles, and the heat exchanger enters a new cycle of energy reclamation without using external energy, except that already contained in the cold waste water.

It is a general object of this invention to provide an effective, efficient and compact tap water prechiller, which can be adapted for use on a wide range of ice machines from small to large sizes, which achieves substantial savings on the machine's operating and maintenance expenses, and which reduces wear and tear on the machine's active parts. The novel prechiller reduces the mineral buildup inside its casing reservoir and substantially enhances the amount of heat that is being transferred in a unit of time across a unit of surface area of the heat exchanger's copper tubing, thereby optimally lowering the tap water's temperature per unit of casing volume, and correspondingly increasing the machine's ice productivity.

SUMMARY OF THE INVENTION

According to the present invention, prechilling the tap water with the cold waste water from an ice machine is achieved by using an insulated, elongated casing having a top cap. The casing encloses a reservoir housing a heat exchanger made of a relatively long tubing made of copper, or the like, to provide a relatively long path of travel for the tap water. The heat exchanger is in the form of a coil followed by a substantially straight tube within and surrounded by the coil's turns. A hollow member, closed at one end, is spaced from the straight tube. The coil's turns surround the hollow member and the straight tube.

Preferably, the hollow member is heat-insulating and is mounted over and is spaced from the straight tube to form there between an elongated chamber. In use, the tap water flows downwardly in the coil toward the lowest coil turn, and upwardly through the straight tube to the ice maker. The cold waste water flows through the elongated chamber into the reservoir and exits through an overflow outlet, thereby progressively and continuously increasing the temperature of the waste water and correspondingly decreasing the tap water's temperature.

DESCRIPTION OF PREFERRED EMBODIMENTS

Figures 1, 2, 3:
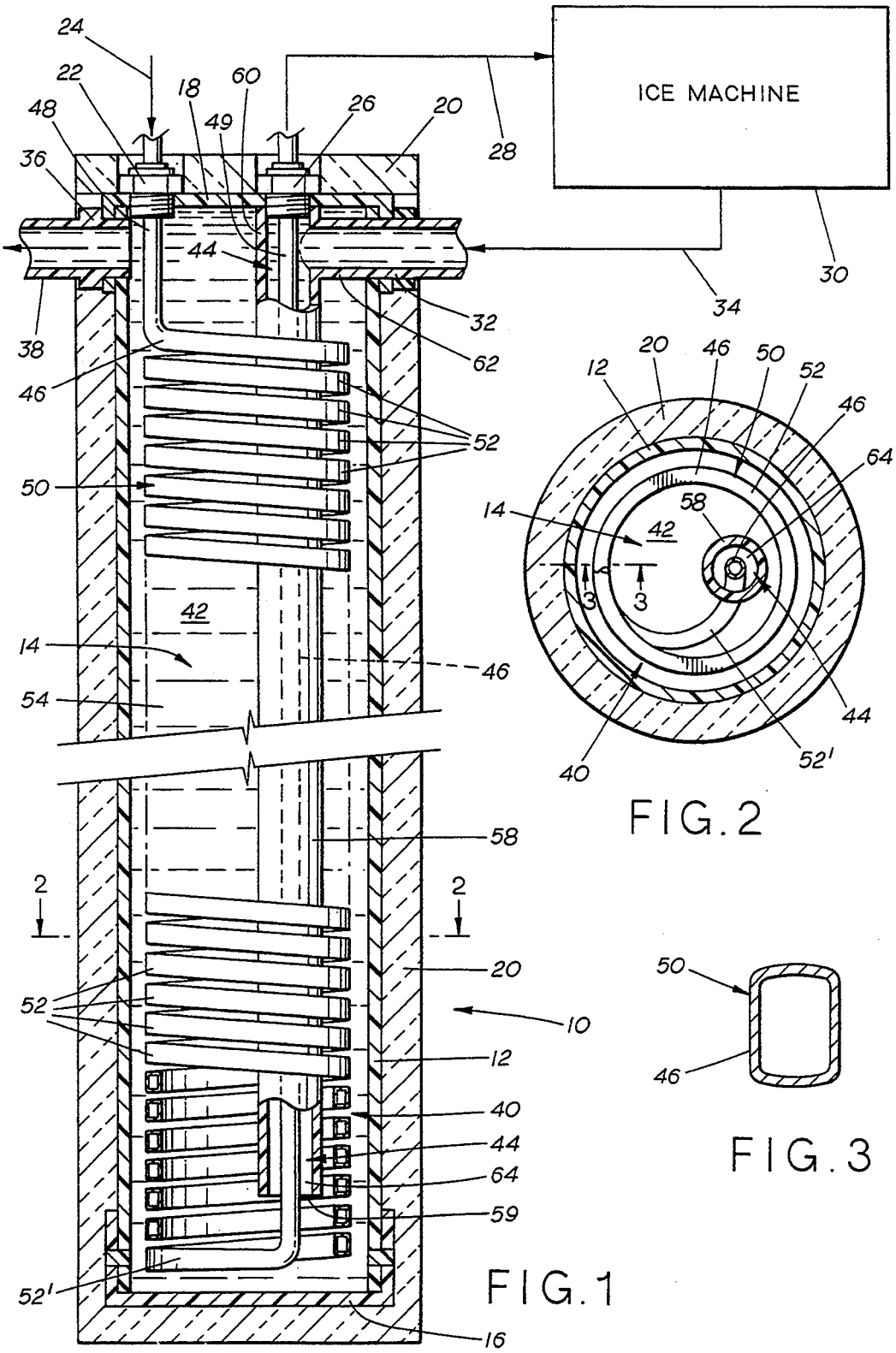
FIG. 1 is a longitudinal sectional view of the prechiller of the present invention.
FIG. 2 is a sectional view of the prechiller taken on line 2–2 of FIG. 1.
FIG. 3 is a sectional view on line 3–3 of FIG. 2 of the long tubing from which the heat exchanger is made up.

In its preferred embodiment and with reference to FIGS. 1–2, the prechiller 10 of this invention has an elongated casing 12, preferably upright, which encloses a reservoir 14. Casing 12 can be a cylindrical pipe section having a bottom cap 16 and a top cap 18. It is entirely covered with a layer of thermal insulation 20.

Top cap 18 has a bulkhead connector 22 for receiving tap water from line 24, and a bulkhead connector 26 through which the prechilled tap water flows out into line 28 of an ice machine 30, such as an ice cube maker used in restaurants, bars, hotels, schools, hospitals, etc. The side wall of top cap 18 has a socket 32 that receives from machine 30 ice cold waste water 54 on line 34, and a socket 36 which allows excess waste water 54 to escape to drain line 38.

Within reservoir 14 is a heat exchanger 40 having a first stage 42 and a second stage 44, both sharing a single continuous tubing 46 of great length compared to the length of casing 12. Tubing 46 is made of a good thermal conductor preferably copper.

The inlet end 48 of tubing 46 is removably coupled to connector 22, and the outlet end 49 of tubing 46 is removably coupled to connector 26.

Tubing 46 in stage 42 is wound into a coil 50 having spiral turns 52 that are near to the inner wall of casing 12 (FIG. 2), thereby substantially increasing the length of the path of travel for the tap water within the casing.

In such coiling, the tube's sectional area is purposely altered from circular to substantially rectangular or oval (FIG. 3). It is believed that such an alteration favorably alters, the flow and heat exchange dynamics, i.e., the heat exchange surface area relative to the volume of tap water contained within tubing 46.

The portion of tubing 46 in second heat exchanger stage 44 is substantially straight and upright and will hereinafter be also designated by the numeral 44. Straight tube 44 is inside of and completely surrounded by turns 52. The bottom end of tube 44 merges smoothly with the lowest turn 52'.

In the preferred embodiment, along substantially its entire length, tube 44 is surrounded by a concentric upright conduit 58, having an open end 59 and a closed off top end 60. Conduit 58 is made of a poor thermal conductor material. In a less preferred embodiment (not shown), tube 44 is outside of and parallel to conduit 58.

The space between tube 44 and the inner wall of conduit 58 forms an elongated chamber 64 for receiving waste water 54 from line 34 through socket 32 and a coupling 62.

In the first ice harvest cycle, from line 34 of ice maker 30 chamber 64 receives ice cold waste water 54 which flows downwardly through chamber 64, along and around straight tube 44, through open bottom end 59 of chamber 64, which is also the bottom of reservoir 14, and upwardly towards the top of reservoir 14, and along and around the coil's turns 52.

Conduit 58 thermally isolates the colder waste water 54 in chamber 64 from the warmer waste water 54 within the rest of reservoir 14.

The inlet 48 of tubing 46 receives from line 24 tap water under pressure which circulates downwardly through turns 52. The tap water flows spirally toward the lowest turn 52', thence upwardly within straight tube 44, and through its tap water outlet 49 into feed line 28 of machine 30 for making ice.

The waste water 54 in reservoir 14 cools the downwardly circulating tap water to progressively lower temperature levels.

The same tap water is further cooled to progressively lower temperature levels as it flows upwardly in straight tube 44 from the lowest turn 52' of coil 50, because the arriving counter flowing coldest waste water 54 from machine 30 maximally lowers the temperature of the tap water in tube 44 before it flows out through outlet 49 into feed line 28.

In chamber 64 the waste water's temperature progressively increases from its top to the bottom of reservoir 14. In reservoir 14 the waste water's temperature progressively increases from its bottom to its top, thereby resulting in a progressive rise in the temperature of the waste water surrounding tubing 46 from inlet socket 32 to to outlet socket 36, whereat it has its highest temperature, while the tap water has its lowest temperature within tube 44 at the level of socket 32.

As a result, the temperature of the tap water within the entire length of tubing 46 is progressively and continuously lowered from its inlet end 48 to its outlet end 49.

The changes in the temperature in the waste water 54 per unit of vertical height enhances the heat transfer from the tap water flowing through tubing 46 to the surrounding waste water 54, and generates water currents within reservoir 14 which tend to maintain the surfaces of heat exchanger 40 free of sediment accumulation.

It is also believed that the substantially rectangular sectional area of tubing 46 tends to improve the amount of heat transferred in a unit of time across a unit of surface area of heat exchanger 40, and in a unit of length of tubing 46.

In summary, the heat exchanger's first stage 42 first prechills the fresh tap water with warmed up waste water received from second stage 44, and second stage 44 further prechills the tap water received from first stage 42 with fresh ice cold waste water received from line 34 into chamber 64.

Hence, the cooling energy within the waste water discharged from ice machine 30, which would otherwise be wasted, is optimally reclaimed by heat exchanger 40 which removes heat energy from the tap water prior to injecting it into the ice making section of machine 30.

Prechiller 10 is effective, efficient and compact. Using it with an ice machine will reduce the heat produced by the machine. Less "wear and tear" will be experienced by the machine's s active parts. There will be less time for mineral buildup on its freeze plate, and its bin will fill up faster with ice during peak demands. It will produce more ice in the same amount of time, or the same amount of ice in a shorter time.

The preferred embodiment for optimum thermal efficiency and adapted for use in most ice maker installations, utilized refrigeration grade copper tubing having a ⅜ inch outside diameter (OD) and a wall thickness of 0.035 inch. Casing (12) had a 4 inch OD, a height of 26 inch, and a reservoir (12) whose volume is 1.44 gallon.

For smaller machines, four feet of copper tubing per linear foot of casing 12 is adequate.

However, for use on a wide range of ice makers from small to large sizes and for optimum thermal efficiency, about 23 feet of copper tubing per linear foot of casing 12 is preferred. In this case, the total length of tubing (46) is 48 feet yielding 54 turns (52), an outside diameter of coil (50) of 3.6 inch, an inside diameter of coil (50) of 2.9 inch, and a length of straight tube (44) of 25.5 inch. Thus, in the universal 4 inch OD cylindrical casing (12), the coil should use between 4 and 23 feet of copper tubing per linear foot of casing (12). The volume of the reservoir (14) with the tubing is about 1.13 gal. for about 23 feet of tubing per linear foot of the casing having about 4" outside diameter and about 26" in length.

Other preferred dimensions include:

| | |
|---|---|
| caps 16 and 18 | 4 inch in diameter |
| hollow member 46 | 1 inch OD<br>23 inch in length |
| bulkbead connectors | ⅜ to ⅜ inch |

The present invention may be carried out in various ways and is not limited to the specific way described above, which is at present the best mode contemplated for accomplishing the objectives previously enumerated, as well as other objectives which will become apparent to those skilled in the art.

For example, while it is preferred for casing 12 to remain upright, in use, the prechiller 10 will function with the casing 12 in an inclined or horizontal position but at a sacrifice in thermal heat exchange efficiency between the warm tap water and the cold waste water.

What is claimed is:

1. In a method for prechilling the warm tap water, fed into an ice maker machine to make ice cubes and the like, with the near freezing waste water ejected by the machine after one or more ice making cycles; said prechilling step using an insulated, elongated casing having top and bottom ends forming there between a closed reservoir housing a heat exchanger made of copper tubing or the like, said casing having a waste water inlet, a tap water inlet, a waste water overflow outlet, and a tap water outlet, the improvement comprising:

forming said heat exchanger in the form of a coil having a plurality of spiral turns for maximum heat transfer and followed by a substantially straight tube portion within and surrounded by said coil turns;

mounting a hollow member, which is closed at one end, and spacing it from said straight tube to be surrounded by said coil turns to form between said hollow member and said straight tube an elongated chamber whose bottom is open to the interior of said reservoir;

fluidly coupling said chamber to said waste water inlet, said coil to said tap water inlet, and said straight tube to said tap water outlet, whereby in use said warm tap water flows under pressure spirally toward the lowest one of said coil turns, thence within said straight tube and through said tap water outlet into said machine for making ice, and said cold waste water flows through said chamber, along and around said straight tube, into the interior of said reservoir along and around said coil turns, and exiting through said overflow outlet, thereby progressively and continuously increasing the waste water's temperature from the top of said chamber to the bottom of said reservoir, and progressively increasing the waste water's temperature from the bottom of said reservoir to said overflow outlet, whereat it has its highest temperature, and progressively and continuously decreasing the temperature of the tap water from the inlet of said coil to near the outlet of said straight tube, whereat said tap water has its lowest temperature.

2. The method of claim 1, and mounting said hollow member over and spacing it from said straight tube to form there between said elongated chamber; and said hollow member being heat-insulating to reduce heat transfer between said chamber and said reservoir.

3. The method of claim 1, wherein the individual walls of the turns of said coil are near the inner wall of said casing thereby increasing the length of the path of tap water travel within said casing.

4. The method of claim 2, wherein the individual walls of the turns of said coil are near the inner wall of said casing thereby increasing the length of the path of tap water travel within said casing.

5. In an apparatus for prechilling the warm tap water, fed into an ice maker machine to make ice cubes and the like, with the near freezing waste water ejected by the machine after one or more ice making cycles; comprising an insulated, elongated casing having top and bottom ends forming there between a closed reservoir housing a heat exchanger made of copper tubing or the like, said casing having a waste water inlet, a tap water inlet, a waste water overflow outlet, and a tap water outlet, the improvement wherein:

said heat exchanger has a coil having a plurality of spiral turns for maximum heat transfer followed by a substantially straight tube portion within and surrounded by said turns;

a hollow member, closed at one end, spaced from said straight tube to be surrounded by said coil turns to form between said hollow member and said straight tube an elongated chamber whose bottom is open to the interior of said reservoir;

said chamber is fluidly coupled to said waste water inlet, said coil is fluidly coupled to said tap water inlet, and said straight tube is fluidly coupled to said tap water outlet, whereby in use said warm tap water .flows under pressure spirally toward the lowest one of said coil turns, thence within said straight tube and through said tap water outlet into said machine for making ice, and said cold waste water flows through said chamber, along and around said straight tube, into the interior of said reservoir, and therein along and around said coil turns, and exiting through said overflow outlet, thereby progressively and continuously increasing the waste water's temperature from the top of said chamber to the bottom of said reservoir, and progressively increasing the waste water's temperature from the bottom of said reservoir to said overflow outlet, whereat it has its highest temperature, and progressively and continuously decreasing the temperature of the tap water from near the inlet of said coil to near the outlet of said straight tube, whereat said tap water has its lowest temperature.

6. The apparatus of claim 5, wherein said hollow member is mounted over and spaced from said straight tube to form there between said elongated chamber; and said hollow member is heat-insulating to reduce heat transfer between said chamber and said reservoir.

7. The apparatus of claim 5, wherein said casing is cylindrical in shape; and said copper tubing has about ⅜" OD, the volume of said reservoir without said tubing is about 1.44 gal. and with said tubing about 1.13 gal. for about 23 feet of tubing per linear foot of said casing having about 4" outside diameter and about 26" in length.

8. The apparatus of claim 6, wherein said casing is cylindrical in shape; and said copper tubing has about ⅜" outside diameter and a range of about 4 feet of tubing per linear foot to about 23 feet of tubing per linear foot when said casing has about 4" outside diameter.

9. The apparatus of claim 5, wherein the individual walls of the turns of said coil are near the inner wall of said casing thereby increasing the length of the path of tap water travel within said casing.

10. The apparatus of claim 6, wherein the individual walls of the turns of said coil are near the inner wall of said casing thereby increasing the length of the path of tap water travel within said casing.

11. The apparatus of claim 7, wherein the individual walls of the turns of said coil are near the inner wall of said casing thereby increasing the length of the path of tap water travel within said casing.

12. The apparatus of claim 8, wherein the individual walls of the turns of said coil are near the inner wall of said casing thereby increasing the length of the path of tap water travel within said casing.

13. The apparatus of claim 12, wherein at least the sectional area of said tubing in said coil is non circular.

14. The apparatus of claim 13, wherein said sectional area is substantially rectangular in shape.

15. The apparatus of claim 13, wherein said sectional area is substantially oval in shape.

16. The apparatus of claim 5, and a first bulkhead connector connected to the inlet of said coil and a second bulkhead connector connected to the outlet of said straight tube.

17. The apparatus of claim 5, wherein said casing is cylindrical in shape; and said copper tubing has about ⅜" outside diameter and a range of about 4 feet of tubing per linear foot to about 23 feet of tubing per linear foot when said casing has about 4" outside diameter.

* * * * *